United States Patent [19]

Frey-Wigger

[11] 4,274,793

[45] Jun. 23, 1981

[54] WORKING PLATFORM

[76] Inventor: Paul Frey-Wigger, am Zeigerwald, Schötz, Switzerland, CH-6247

[21] Appl. No.: 793,970

[22] Filed: May 5, 1977

[30] Foreign Application Priority Data

May 5, 1976 [CH] Switzerland ..... 5611/76

[51] Int. Cl.[3] ..... B66F 9/06

[52] U.S. Cl. ..... 414/607; 212/251; 182/2; 182/63

[58] Field of Search ..... 182/2, 63; 214/730, 214/620, 621; 212/8 R, 9; 414/607, 629–634, 723, 724

[56] References Cited

U.S. PATENT DOCUMENTS

| | | | |
|---|---|---|---|
| 1,337,487 | 4/1920 | Schlatter | 182/63 |
| 2,632,530 | 3/1953 | Wagner | 182/63 |
| 2,821,312 | 1/1958 | Wiegel | 182/2 |
| 3,504,461 | 4/1970 | Copeland et al. | 182/2 |
| 3,608,669 | 9/1971 | Lindsay, Jr. | 182/63 |
| 3,647,099 | 3/1972 | Carriere | 214/620 |
| 3,907,142 | 9/1975 | Welch | 214/620 |
| 3,966,070 | 6/1976 | Barth | 414/607 |

*Primary Examiner*—Lawrence J. Oresky
*Attorney, Agent, or Firm*—Peter K. Kontler

[57] ABSTRACT

The boom of a crane carries a pivot bearing for a second bearing which guides an elongated column. The upper or the lower end of the column supports a gallery which is turnable about its axis. The second bearing is pivotable about the horizontal axis of the pivot bearing by a cylinder-and-piston unit, and the column is movable lengthwise with respect to the second bearing by the crane cable.

5 Claims, 3 Drawing Figures

WORKING PLATFORM

BACKGROUND OF THE INVENTION

The present invention relates to a working platform with a gallery which is mounted on a column and is turnable about the longitudinal axis of the column, which column is axially movably mounted in a shifting bearing and the shifting bearing is pivotably mounted in a pivot bearing for movement about an axis which is oriented transversely of the longitudinal axis of the column, and with a mobile boom which is turnable about a vertical axis with the pivot bearing mounted at the end of the boom.

A working platform of such type is known as a bridge inspection apparatus and is described, for example, in German Pat. No. 1,216,914. Owing to their specific construction, such single-purpose apparatus cannot be utilized for the cleaning of facades of tall buildings or the like. It is already known to employ mobile single-purpose apparatus, known as "skyworker", for work on the facades or the like. Such apparatus consist of several articulately connected arms the last of which carries at its free end a basket for one or two workers. A drawback common to both single-purpose apparatus is that their field of application is limited; this results in undesirable cost-producing idle times which must be charged to the hours of productive use.

OBJECTS AND SUMMARY OF THE INVENTION

An object of the present invention is to provide a working platform which can be used as a bridge inspection apparatus as well as for the cleaning of facades or the like.

In accordance with the invention, this object is achieved in that the mobile boom is a pneumatic crane and that the column is provided with a fastening point for the end of the crane cable for the purpose. of lifting or lowering the column in the shifting bearing by means of the crane cable.

The invention brings about the advantage that one can employ commercially available automatic cranes so that a new field of application is opened for such types of cranes.

DESCRIPTION OF THE PREFERRED EMBODIMENTS

Figure 1:
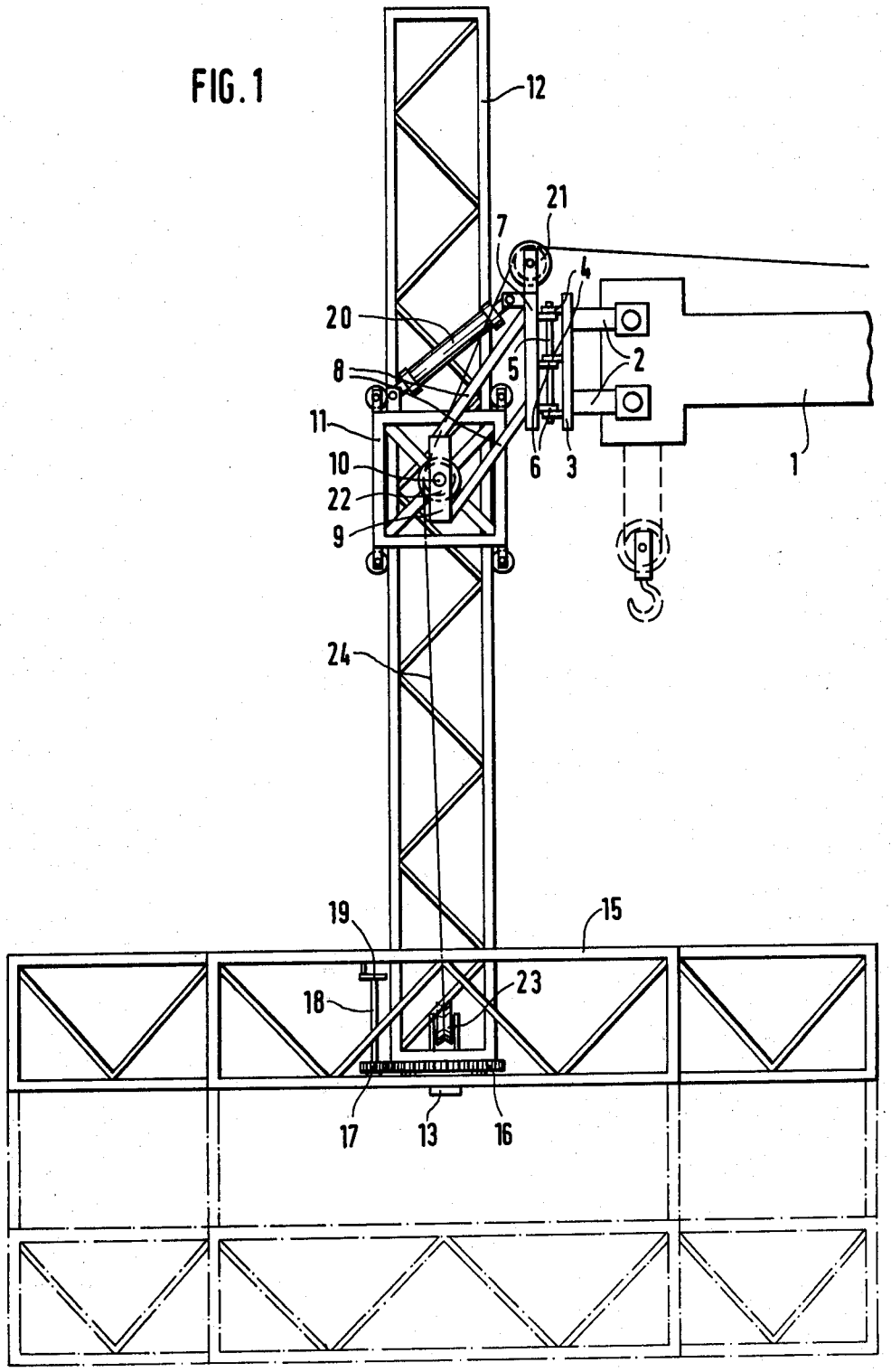
FIG. 1 shows a section of a working platform with the gallery in a first position.

A plate 3 is secured by means of four braces 2 (only two shown in the drawing) to the upper end of a preferably telescopically extendable boom 1 of a pneumatic crane. The plate 3 comprises six projecting lugs 4 which are disposed in two rows, one behind the other. The lugs 4 of each row are provided with coaxial bores for reception of one insertable pin 5 each. Each lug 4 corresponds to a lug 6 which latter lugs are secured to a plate 7. The insertable pins 5 further extend through coaxial bores of the lugs 6 so that they separably but securely couple the plates 3 and 7 to each other. A pivot bearing 9 is secured to the plate 7 by means of braces 8, and a second bearing 11 is pivotably mounted to the bearing 9 for movement about a shaft 10. A column 12 is axially movably mounted in the bearing 11 and has a pivot pin 13 at its lower end. An outwardly extending carrier 14 is mounted on the pivot pin 13, and this carrier supports a gallery 15. The gallery 15 consists of one or more parts which can be assembled so that the length of the gallery can conform to given requirements. The lower end of the column 12 carries a ring gear 16 which meshes with a gear 17 fixed to a shaft 18. The shaft 18 is rotatably journalled in the carrier 14 and its upper end carries a hand-operated crank wheel 19. By rotating the crank wheel 19, the persons occupying the gallery 15 can swing the latter about the column 12.

A cylinder-piston unit 20 is provided to turn the bearing 11 about the shaft 10. The cylinder of the cylinder-piston unit 20 is articulately connected to the plate 7 and the piston rod is articulately connected to the bearing 11. By means of the cylinder-piston unit 20, the column 12 can be oriented and held in a vertical position independently of inclination of the boom 1. A roller 21 is rotatably mounted on the plate 7. Furthermore rotary rollers 22 and 23 are respectively provided on the shaft 10 and at the lower end of the column 12. A crane cable 24 is trained over the rollers 21, 22 and 23 and is secured to the shaft 10 by load hooks, not shown. In this manner, the column 12 can be lifted or lowered by the crane cable without resorting to a separate drive.

Figure 2:
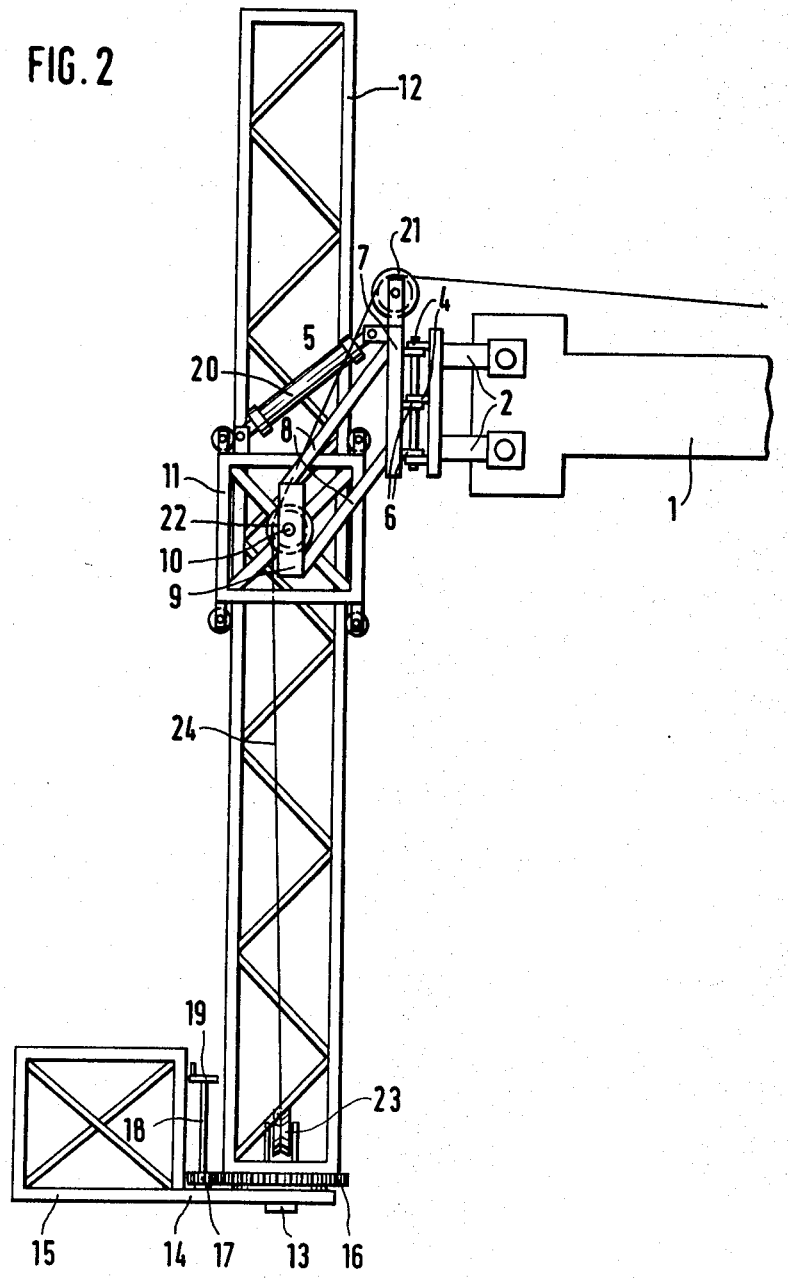
FIG. 2 is a view similar to that of FIG. 1, with the gallery in a second position turned through 90 degrees.
Figure 3:
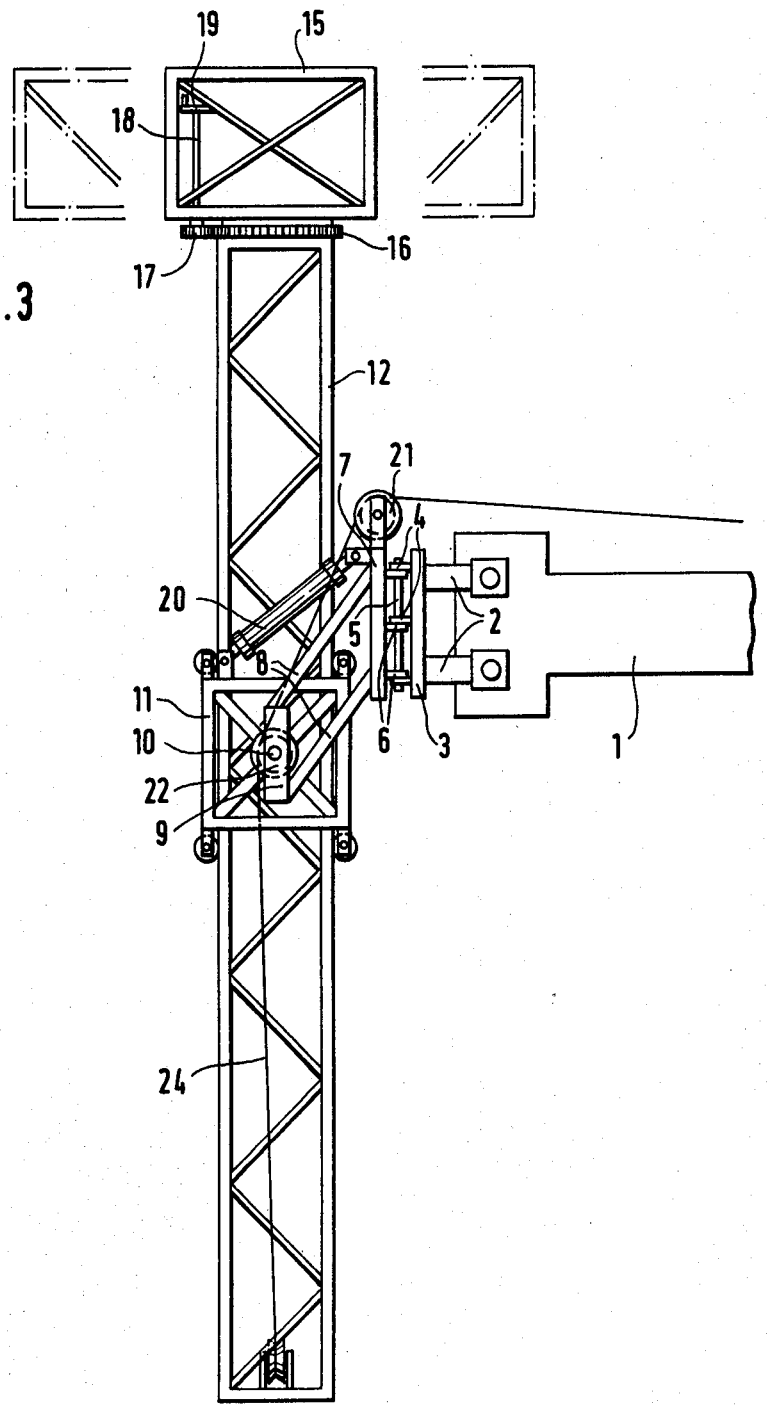
FIG. 3 is a view similar to that of FIG. 2 but with a different arrangement of gallery.

In the example of FIG. 3, similar reference characters denote parts which are identical with or equivalent to those in the example of FIG. 2. In contrast to the first example, the gallery 15 is secured here at the upper end of the column 12 which effects a further increase of the working height.

As indicated in FIG. 1 by broken lines, a second load hook which is provided on the crane can be used to lift working equipment, working material or the like onto the gallery 15.

In accordance with an embodiment which is not shown, two galleries can be disposed in parallel one above the other. This embodiment will be employed with preference for washing of building facades.

What is claimed is:

1. A working platform for attachment to a crane, comprising a substantially horizontal pivot bearing; means for detachably securing said pivot bearing to the end portion of the boom of a crane, including a plate, a plurality of lugs extending from said plate and having coaxial bores for reception of pins therein and braces securing said plate to said pivot bearing; a second bearing mounted in said pivot bearing; an elongated column reciprocably mounted in said second bearing; a gallery; means for movably mounting said gallery on said column; and means for securing a crane cable to said column so that, when in use, the cable moves said column with respect to said second bearing.

2. A working platform as defined in claim 1, further comprising a cylinder-piston unit connected between said plate and said second bearing so that said column can be oriented and held in a vertical position independently of the inclination of a boom to which the working platform may be attached.

3. A working platform as defined in claim 2, further comprising a pivot pin at the lower end of said column, a carrier mounted on said pivot pin and supporting said gallery, a shaft journalled in said carrier, a first gear fixed to the end of said shaft, a second gear carried by the lower end of said column and meshing with said first gear and means for turning said shaft so that said gallery can be rotated about said column.

4. A working platform as defined in claim 2, further comprising a shaft in said pivot bearing, said pivot bearing and said second bearing being movable about the axis of said shaft.

5. A working platform as defined in claim 4, further comprising a first roller rotatably mounted on said plate, a second roller mounted on said shaft, and a third roller mounted at the lower end of said column, said rollers being adapted to receive a crane cable.

* * * * *